US008410708B2

(12) United States Patent
Hsu

(10) Patent No.: US 8,410,708 B2
(45) Date of Patent: Apr. 2, 2013

(54) STRUCTURE OF AN LED DECORATION LAMP

(76) Inventor: Fu-Hsien Hsu, Hsinchu (TW)

( * ) Notice: Subject to any disclaimer, the term of this patent is extended or adjusted under 35 U.S.C. 154(b) by 383 days.

(21) Appl. No.: 12/958,422

(22) Filed: Dec. 2, 2010

(65) Prior Publication Data

US 2011/0074300 A1 Mar. 31, 2011

Related U.S. Application Data

(63) Continuation-in-part of application No. 12/010,666, filed on Jan. 29, 2008, now abandoned.

(51) Int. Cl.
*H05B 37/00* (2006.01)
*F21V 15/00* (2006.01)

(52) U.S. Cl. ..... 315/185 S; 315/209 R; 315/247; 315/291; 315/312; 362/362; 362/227; 362/800; 362/806

(58) Field of Classification Search ..... 315/185 S, 315/247, 291, 209 R, 224, 307, 312–326; 362/611, 612, 227, 555, 362, 800–812
See application file for complete search history.

(56) References Cited

U.S. PATENT DOCUMENTS

2011/0182065 A1* 7/2011 Negley et al. ..... 362/231

* cited by examiner

*Primary Examiner* — Tuyet Thi Vo
(74) *Attorney, Agent, or Firm* — Leong C. Lei

(57) ABSTRACT

A dual colored LED decoration lamp which includes a lamp string combined of multiple dual colored LED lights and a controller connected between the power supply and the lamp string. The lamp string includes lamp groups combined of multiple LED lights with two different colors and with their anodes and cathodes cross-linked. The multiple lamp groups are then connected in series, and each LED light in every lamp group is connected in same direction with the same colored LED light in the next lamp group. The controller controls the variation of the direction of current in aforementioned lamp strings. Thus, the lamp string is able to emit light with different colors by varying the current direction in the same lamp string through the usage of controller, and there is no need to set with multiple lamp strings.

5 Claims, 3 Drawing Sheets

STRUCTURE OF AN LED DECORATION LAMP

CROSS-REFERENCE TO RELATED APPLICATION

This is a continuation-in-part of the patent application Ser. No. 12/010,666 filed Jan. 29, 2008, now abandoned.

BACKGROUND OF THE INVENTION

1. Field of the Invention

This invention is related to an improvement in the structure of an LED decoration lamp which can switch two kinds of colors as desired.

2. Description of the Prior Art

Referring to FIGS. 1 and 2, the prior art LED decoration lamps with exchangeable dual colors are linked in parallel with lamp strings with two colors and are linked in series with a controller. By controlling the conduction of time sequences of the circuitry where the lamp strings with different colors are mounted through the controller, the string lamps with different colors can be lightened at different time periods and the color varying effects are thus achieved in the whole LED decoration lamp. The linkage of the whole LED decoration lamp needs three conductive wires with different polarities due to the setup of two circuitries. Simultaneously, a lamp group is then formed with assembling the LED lights together in the lamp strings with different colors. Certain distances are set between different groups based on the requirement which makes the required volume become larger in this kind of decoration lamp thereby making it hard to be used.

Therefore, it is an object of the present invention to provide an improvement in the structure of an LED decoration lamp which can obviate and mitigate the above-mentioned drawbacks.

SUMMARY OF THE INVENTION

The technical problem to be solved in the present invention is to provide a kind of dual colored LED lamp with a simpler linking structure and smaller volume that can overcome the disadvantages of the dual-color LED decoration lamp with complex structure in the prior art.

The technical plan of the present invention adopted to solve the aforementioned technical problem is: a kind of dual-color LED decoration lamp which includes a lamp string combined of multiple dual-color LED lights and a controller connected between the power supply and the aforementioned lamp string. The aforementioned lamp string includes lamp groups combined of multiple LED lights with two different colors and with their anodes and cathodes cross-linked. The aforementioned multiple lamp groups are then connected in series, and each LED light in every lamp group is connected in same direction with the same colored LED light in the next lamp group. The aforementioned controller controls the variation of the direction of current in aforementioned lamp strings.

In the dual-color decoration lamp described in the present invention, two LED lights in the aforementioned lamp group are set inside one lamp body.

In the dual-color decoration lamp described in the present invention, the aforementioned controller connects with the power supply through the plug.

The implement of LED decoration lamp in the present invention has the following benefits: the aforementioned lamp string through setup is formed with multiple lamp-groups linked together in series. Two LED lights with different colors and with their anodes and cathodes cross-linked are included in each lamp group. The same colored LED lights to be linked in the same direction are guaranteed while multiple lamp groups are linked together to form lamp strings.

Thus, the lamp string is able to emit light with different colors by varying the current direction in the same lamp string through the usage of controller, and there is no need to set with multiple lamp strings. The linkage structure becomes simpler. The LED lights with two different colors in the same lamp group are set in the same lamp body to make the volume of the whole LED decoration lamp smaller and to be hanged or wrapped conveniently on the materials needs to be decorated while usage.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
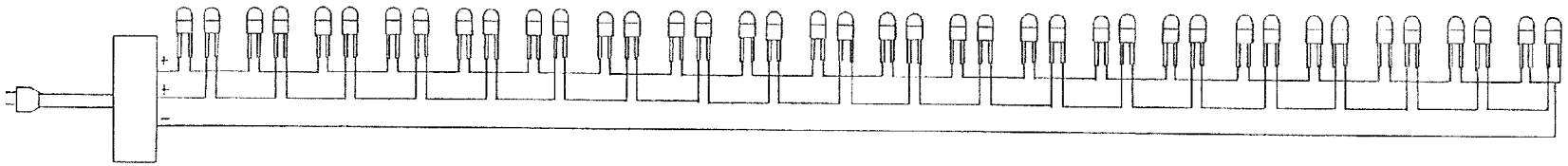
FIG.2 PRIOR ART
FIG. 2 illustrates a second prior art dual-color LED decoration lamp.
Figure 1:
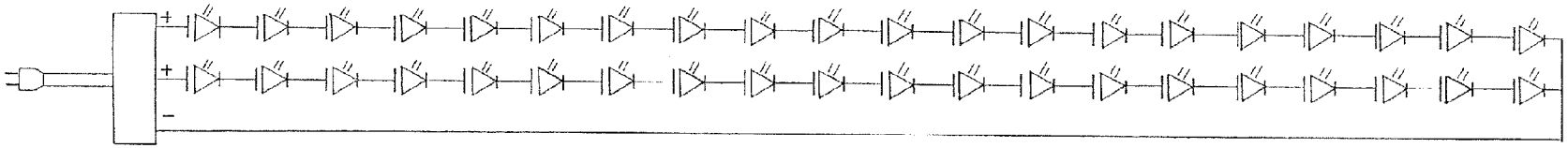
FIG.1 PRIOR ART
FIG. 1 illustrates a first prior art dual-color LED decoration lamp.
Figure 4:
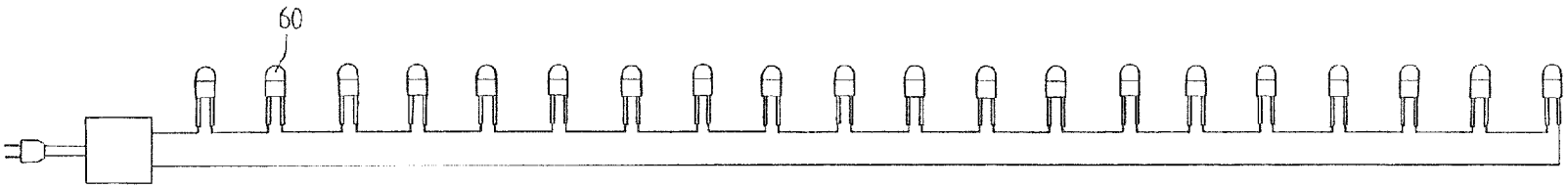
FIG. 4 illustrates a circuit diagram of the dual-color LED decoration lamp according to the present invention.
Figure 3:
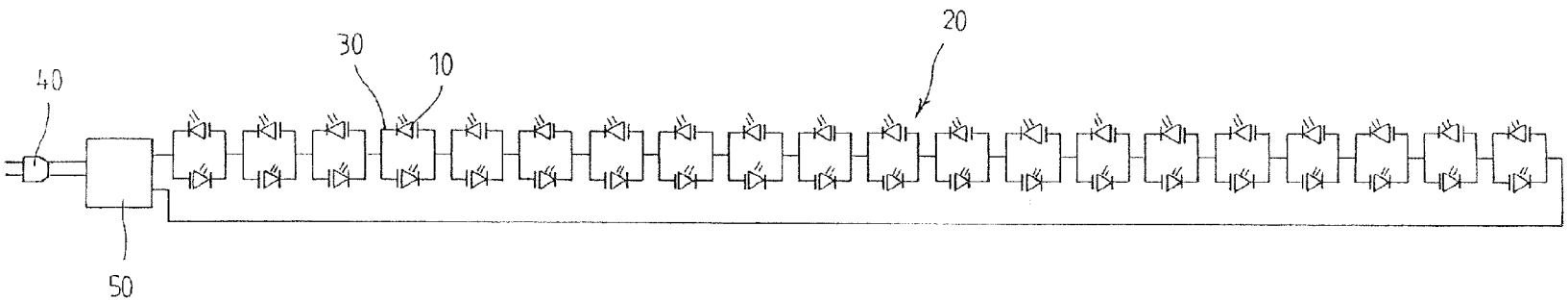
FIG. 3 illustrates the dual-color LED decoration lamp according to the present invention.

As shown in FIGS. 3 and 4, the preferred embodiment in the present invention includes a lamp string 20 formed with multiple dual-color LED lights 10 and a controller 50 connected between the power supply and the aforementioned lamp string 20. The LED light 10 has two different colors such as red and green, yellow and blue . . . etc. Two LED lights 10 with different colors form a lamp group 30. In the first lamp group 30, the cathode of the first colored LED light is linked with the anode of the second colored LED light, and the cathode of the second colored LED light is linked with the anode of the first colored LED light. That is, two LED lights with different colors are formed cross-linked together with their anodes and cathodes in the same lamp group 30. A plurality of the aforementioned lamp groups are linked together to form an aforementioned lamp string 20. In the aforementioned lamp strings 20, the cathode of the first colored LED light in each lamp group 30 is linked with the anode of the second colored LED light in the next lamp group, and the anode of the second colored LED light is linked with the cathode of the second colored LED light in the next lamp group. That is, the serial connection point between each lamps group and the next lamp group is set at the cross linked points between dual-color lights in the same lamp group. A lamp string 20 is thus formed with a connection of same polarity between the first colored LED light in each lamp group and the second colored LED light in the next lamp group. The lamp string 20 is connected to the external power supply through a plug 40. The aforementioned controller 50 is set between the plug 40 and the lamp string 20. The controller 50 is used for controlling the change of current direction in the lamp string 20. While the current flows in the first direction, the first colored LED light in the lamp string 20 is positively conducted and the second colored LED light is non-conducted in reverse, thus the aforementioned lamp string 20 emits the light with the first color. While the controller 50 controls the current direction to change to the second direction, the first colored LED light in the aforementioned lamp string 20 is non-conducted in reverse and the second colored LED light is positively conducted, thus the aforementioned lamp string 20 emits the light with the second color. Therefore, by the change of current direction through the controller 50, the same lamp string 20 is able to emit two kinds of colors without the requirement of multiple lamp strings, thus making the linking structure become simpler.

As shown in FIG. 4, in the aforementioned preferred embodiment of the dual colored LED decoration lamp in the present invention, the aforementioned two LED lights in the same lamp group is able to be set in the same body 60, their mutual cross-linkage between anodes and cathodes is set inside the body 60 to allow the said lamp group to be set in the body 60 and the body 60 has only two guiding wires. Although the whole decoration lamp is still combined with two circuitries, there are only two conductive wires needed. Their volumes become smaller and weights become lighter, and they can be conveniently hanged or wrapped on the materials or at the sites needed to be decorated without the usages of special nails . . . etc. to support the weight or the fixed braces to fix these decoration lamps. Thus, the usage becomes more convenient and flexible.

Accordingly, the controller 50 may control only the first LED light or only the second LED light of the lamp groups of the lamp string 20 to emit light as desired. As the first LED light is different from the second LED light in color, the user may control the first or the second LED light to emit a single color, or control the first and second LED lights to emit light alternately thereby causing lamp string 20 to emit light of two colors.

Figure 6:
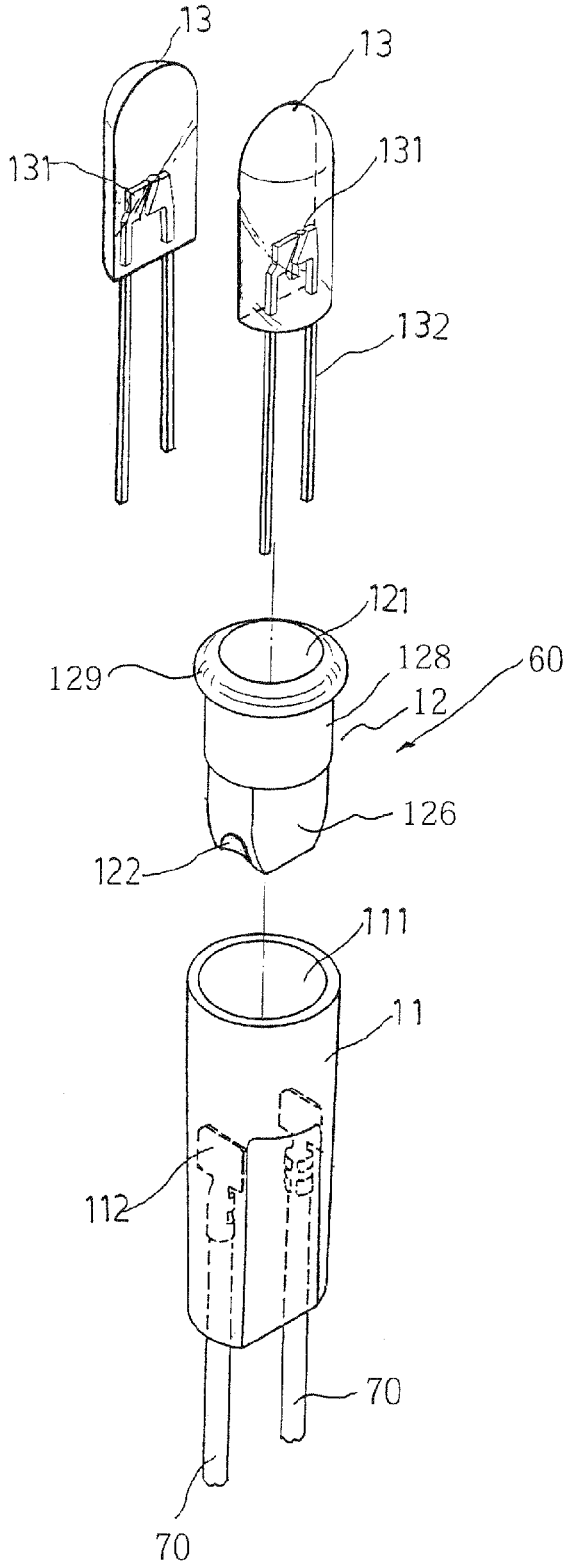
FIG. 6 is an exploded view of the lamp body according to the present invention.
Figure 5:
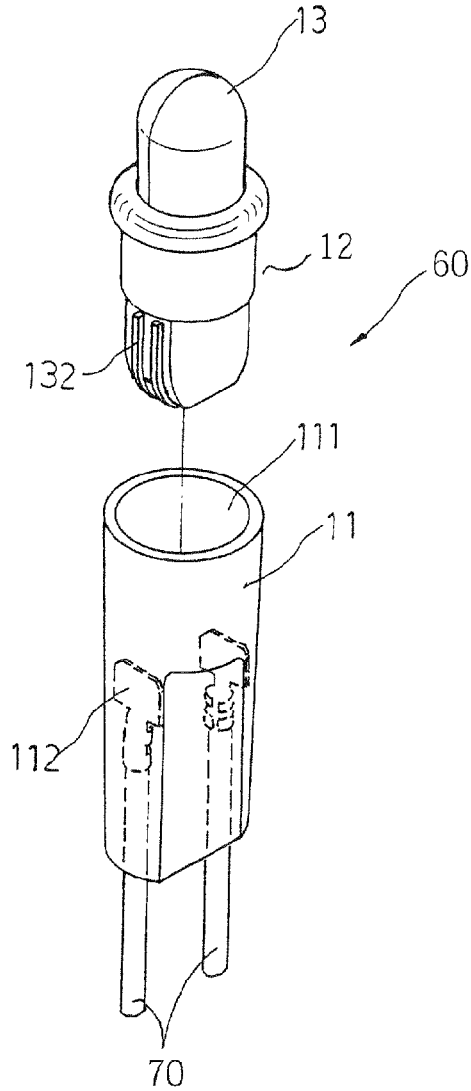
FIG. 5 is a perspective view of the lamp body according to the present invention.

Referring to FIGS. 5 and 6, the lamp body 60 comprises a soft head 11, a soft core 12, and a bulb 13. The bulb 13 is a cylindrical member composed of two halves each being an LED light provided with a single lighting crystalline grain 131 and two connecting pins 132. Hence, the bulb 13 includes two light crystalline grains and four connecting pins 132. The soft head 11 is provided with a cylindrical recess 111 for receiving the soft core 12 and two conducting pins 70 extending downwardly out of the soft head 11. The upper end of each of the conducting pins 70 is connected with an electrode 112 made of copper. The soft core 12 has a cylindrical body 128 provided at the top with a flange 129 and a block 126 at the lower portion. The flange 129 has a larger outer diameter than the top of the soft head 11. The cylindrical body 128 is formed with a cylindrical cavity 121 which has four through holes 122 (only one can be seen in the figure) at the bottom. The cylindrical cavity 121 of the cylindrical body 128 of the soft core 12 is used for receiving the bulb 13 and the through holes 122 of the soft core 12 is designed for the passage of the connecting pins 132 of the bulb 13. When in use, the two halves of the bulb 13 is first combined together to form a cylindrical bulb, and then the bulb 13 is inserted into the cavity 121 of the soft core 12 with the connecting pins 132 of the former extending through the holes 122 of the latter. Thereafter, the connecting pins 132 of the bulb 13 are bent upwardly against two sides of the soft core 12. Then, the soft core 12 together with the bulb 13 is inserted into the cylindrical recess 111 of the soft head 11, with the connecting pins 132 of the bulb 13 contacting the electrodes 112 of the soft head 11.

It should be noted, however, that the bulb 13 may be of any desired shape composed of two similar halves or two supplementary portions.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An LED decoration lamp comprising:

a lamp string including a plurality of lamp groups which are connected in series, said lamp string having a first end and a second end, each of said lamp groups having a first LED light and a second LED light, anode of said first LED light being connected to cathode of said second LED light, cathode of said second LED light being connected to anode of said first LED light, said first LED light and said second LED light of each of said lamp groups being different in color;

a conductive wire having a first end and a second end, said first end of said conductive wire being connected with said first end of said lamp string; and a controller having two output ends and two input ends, said output ends being connected with said second end of said conductive wire and said second end of said lamp string, said input ends being connected with a power supply;

wherein said controller controls current direction in said lamp string so that when current flows in a first direction, said first LED light is positively conducted and said second LED light is non-conducted thus causing said first LED light to emit light, but when current flows in a second direction, said second LED light is positively conducted and said first LED light is non-conducted thus causing said second LED light to emit light, and thereby said controller can control only said first LED light or only said second LED light of said lamp groups of said lamp string to emit light as desired, and therefore said controller can control said first or second LED light to emit a single color, or control said first and second LED light to emit light alternately, causing the lamp string to emit light of two colors; and wherein said first LED light and said second LED light are combined together to form a bulb fitted in a lamp body, each of said first LED light and second LED light being provided with a single lighting crystalline grain and two connecting pins, said lamp body having a soft head and a soft core, said soft head being provided with two conducting pins extending downwardly out of said soft head and a recess in which is fitted said soft core, an upper end of each of said conducting pins being connected with an electrode, said soft core having a body formed with a cavity, said bulb being fitted into said cavity of said soft core with said connecting pins extending downwardly through said cavity and then bent against two sides of said soft core, said soft core being then inserted into said recess of said soft head with said connecting pins of said bulb contacting said electrodes of said soft head.

2. The LED decoration lamp as claimed in claim 1, wherein said first LED light and said second LED light are semi-cylindrical in shape.

3. The LED decoration lamp as claimed in claim 1, wherein said body of said soft core has a top provided with a flange.

4. The LED decoration lamp as claimed in claim 1, wherein said body of said soft core has a lower portion provided with a block having four holes for passage of said connecting pins of said first LED light and said second LED light.

5. The LED decoration lamp as claimed in claim 1, wherein said flange of said soft core has a larger outer diameter than a top of said soft head.

* * * * *